US009168541B2

(12) United States Patent
Hung

(10) Patent No.: US 9,168,541 B2
(45) Date of Patent: Oct. 27, 2015

(54) SHIELD ASSEMBLY OF LOW-FLOW SPRINKLER

(71) Applicant: PLASTICO CORPORATION, Taipei (TW)

(72) Inventor: Shih-Min Hung, Taipei (TW)

(73) Assignee: Plastico Corporation, Taipei (TW)

( * ) Notice: Subject to any disclaimer, the term of this patent is extended or adjusted under 35 U.S.C. 154(b) by 441 days.

(21) Appl. No.: 13/744,816

(22) Filed: Jan. 18, 2013

(65) Prior Publication Data

US 2014/0203106 A1 Jul. 24, 2014

(51) Int. Cl.

| | |
|---|---|
| ***B05B 1/26*** | (2006.01) |
| ***B05B 3/08*** | (2006.01) |
| ***B05B 1/16*** | (2006.01) |
| ***B05B 1/28*** | (2006.01) |
| ***B05B 3/04*** | (2006.01) |
| ***B05B 3/10*** | (2006.01) |

(52) U.S. Cl.

CPC . *B05B 1/16* (2013.01); *B05B 1/262* (2013.01); *B05B 1/265* (2013.01); *B05B 1/28* (2013.01); *B05B 3/0481* (2013.01); *B05B 3/085* (2013.01); *B05B 3/1057* (2013.01)

(58) Field of Classification Search

CPC ..... B05B 1/262; B05B 1/265; B05B 1/267; B05B 3/08; B05B 3/085

See application file for complete search history.

(56) References Cited

U.S. PATENT DOCUMENTS

| | | | | |
|---|---|---|---|---|
| 4,191,331 | A * | 3/1980 | Bivens et al. | 239/231 |
| 4,376,513 | A * | 3/1983 | Hagar | 239/231 |
| 4,461,423 | A * | 7/1984 | Davis | 239/231 |
| 6,336,599 | B1 * | 1/2002 | Herr et al. | 239/522 |
| 7,048,208 | B1 * | 5/2006 | Pruitt et al. | 239/461 |
| 7,066,404 | B1 * | 6/2006 | Kollar | 239/288 |
| 7,216,817 | B2 * | 5/2007 | Turk et al. | 239/230 |

* cited by examiner

*Primary Examiner* — Ryan Reis

(74) *Attorney, Agent, or Firm* — Rosenberg, Klein & Lee

(57) ABSTRACT

The invention relates to a shield assembly of low-flow sprinkler comprises: a support body, a low-flow sprinkler assembly arranged in the support body and a plurality of shield units sequentially combined to form an arc-shaped shield to be easily installed on the low-flow sprinkler and convenience to adjust sprinkling orientation for the required sprinkling area and to increase or decrease the number of shield units for adjusting the sprinkling angle in order to enhance sprinkling orientation and angle precision.

3 Claims, 11 Drawing Sheets

SHIELD ASSEMBLY OF LOW-FLOW SPRINKLER

BACKGROUND OF THE INVENTION

1. Field of the Invention

The invention relates to a low-flow sprinkler, particularly to a shield assembly of adjustable sprinkling angle and orientation 2. Description of the Related Art Since the 1930s, the impact sprinkler has been applied for the allocation of water in agricultural irrigation. The typical impact sprinkler provides a discharge member or a deflector to guide the water into a spoon connected to a rotary shaft for the water to be in a radial distribution. The impact sprinkler distributes the water in a circular rotation. It is also known as a rotary sprinkler or low-flow sprinkler.

FIGS. 1A to 1C show an impact sprinkler 10 and such type of patent includes U.S. Pat. Nos. 7,216,817, 7,954,731, and US Patent Pub. No. 2011/0198411A1. The impact sprinkler 10 includes a support 11 supporting a sprinkler assembly 12. The sprinkler assembly 12 includes a rotary member 121, an impact disc 122, a spoon 123, a rotary shaft 124 and a deflector 125. The support 11 has a bottom connected to an inlet nozzle 13. Based on the features disclosed, the impact sprinkler 10 radially sprinkles in a circular rotation. The principle of the impact sprinkler 10 is disclosed in aforesaid prior art designs and thus will not be described in details here.

The conventional impact sprinkler 10 has sprinkling angle of 360°. However, in some cases, the sprinkling angle may be required only for 0°~180° such that the direction at the sprinkling angle of 180°~360° may be a waste of water resource. To this end, the conventional impact sprinkler 10 provides a control shield (not shown) at a side of the support 11 to control the sprinkling angle.

This kind of the shield is a plastic integrally molded to a C-type body fixed on the side of the support 11 and there are some drawbacks thereof. The sprinkling angle of the C-type body is fixed when producing so it cannot be adjusted as required; that is, the sprinkling angle is not accurate enough and therefore there is room for improvement.

SUMMARY OF THE INVENTION

It is a primary object of the present invention to provide a shield assembly of low-flow sprinkler, which adjusts combinations of an arc-shaped body as required to control the sprinkling width and achieve easy operation.

It is another object of the present invention to provide a shield assembly of low-flow sprinkler, which is installed in the east, west, south, north, northeast, southwest or other orientation to adjust sprinkling angle.

In order to achieve the above objects, the shield assembly of low-flow sprinkler comprises: a support body composed of a rib and a bottom plate and the bottom plate having a through hole at middle thereof for arranging a nozzle; a low-flow sprinkler assembly arranged in the support body and having a rotation shaft in the through hole;

wherein the bottom plate has a bottom surface connected to a neck and a bottom surface of the neck has an equilateral polygon boss paralleling to the bottom plate;

two pieces of semi-circular shield frame corresponding to each other are arranged at both sides of the neck to form a circular convex ring body, a bottom surface of the circular convex ring body corresponding to the equilateral polygon boss has an equilateral polygon recessed frame to fix on the equilateral polygon boss and locate at a periphery of the bottom plate and a plurality of equally spaced mounted holes are axially arranged at a periphery of the circular convex ring body;

a plurality of shield units corresponding to an outer periphery of the circular convex ring body has a curved plate body, the plate body has a width between ⅛ and 1/16 of the outer periphery of the circular convex ring body, the curved plate body is upward extended to form an inward curved body, the curved body has a curved concave groove at a front side wall thereof and a curved convex rib is arranged at a rear side thereof for inserting into the curved concave groove such that the predetermined number of the shield units are sequentially combined, each plate body has a flange at an inner edge surface thereof to set across the circular convex ring body and the flange has an axial screw hole; and a plurality of long screws are upward extending from a bottom surface of the mounted hole of the circular convex ring body to lock into the axial screw hole of the flange;

whereby a plurality of the shield units are sequentially combined to form an arc-shaped shield and the flange is fixed on the circular convex ring body to adjust the number of combinations of the shield unit as required in order to control the sprinkling angle and the circular convex ring body is disassembled into two semi-circular shield frame to adjust the orientation of the arc-shaped shield in order to re-combine the shield units.

Base on the features disclosed, the present invention is easily to be installed on the low-flow sprinkler and is convenience to adjust sprinkling orientation for the required sprinkling area and to increase or decrease the number of shield units for adjusting the sprinkling angle in order to enhance sprinkling orientation and angle precision and achieve easy operation.

DETAILED DESCRIPTION OF THE PREFERRED EMBODIMENT

Figure 1A:
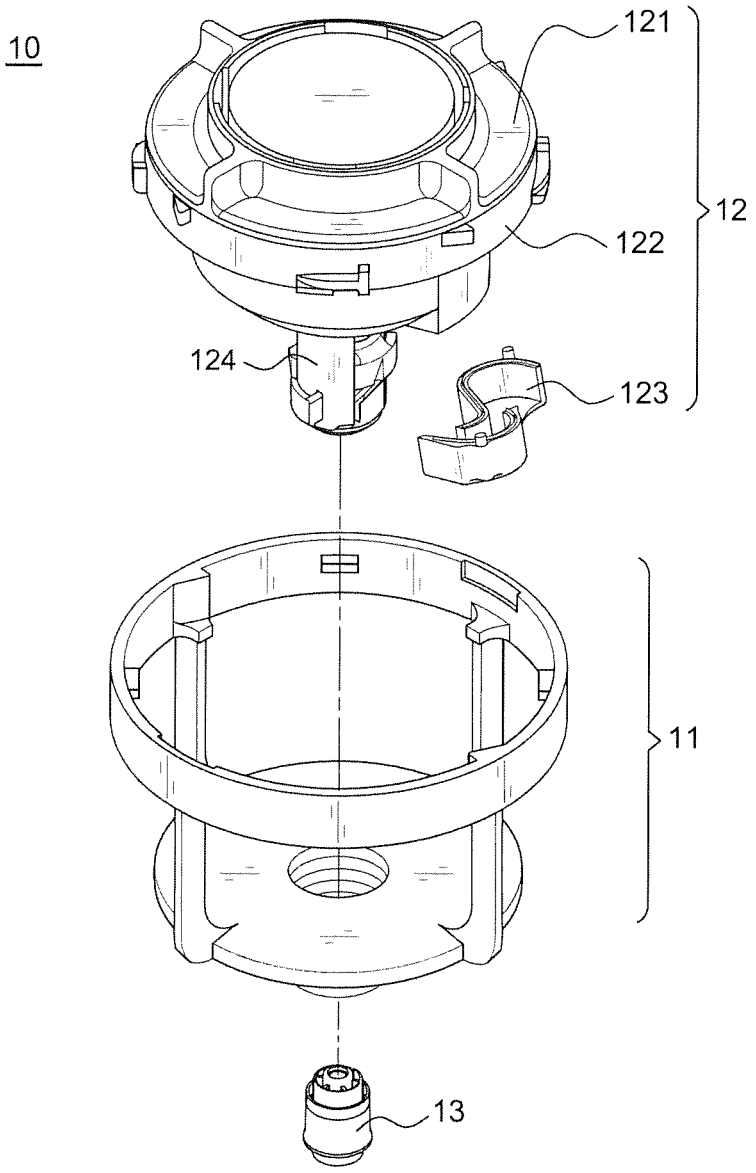
FIG.1A PRIOR ART
FIG. 1A is an exploded elevational view of a conventional sprinkler.
Figure 1B:
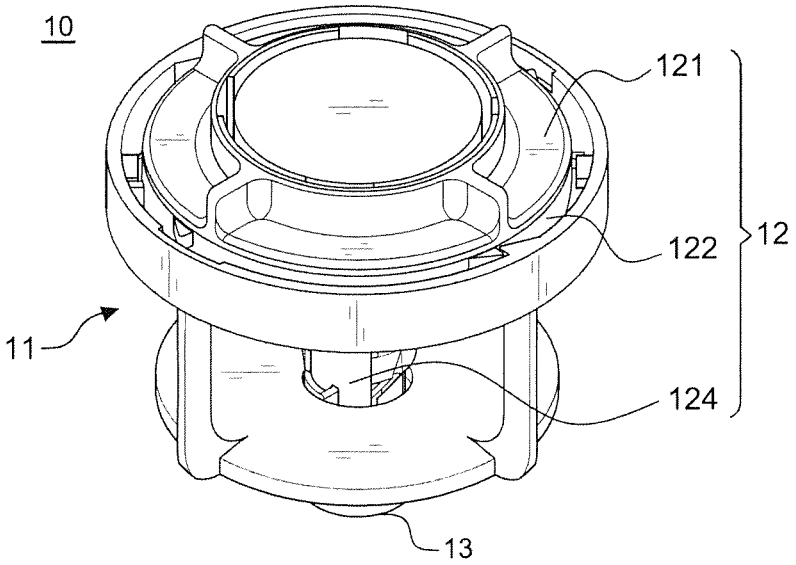
FIG.1B PRIOR ART
FIG. 1B is an assembled elevational view of the conventional sprinkler.
Figure 1C:
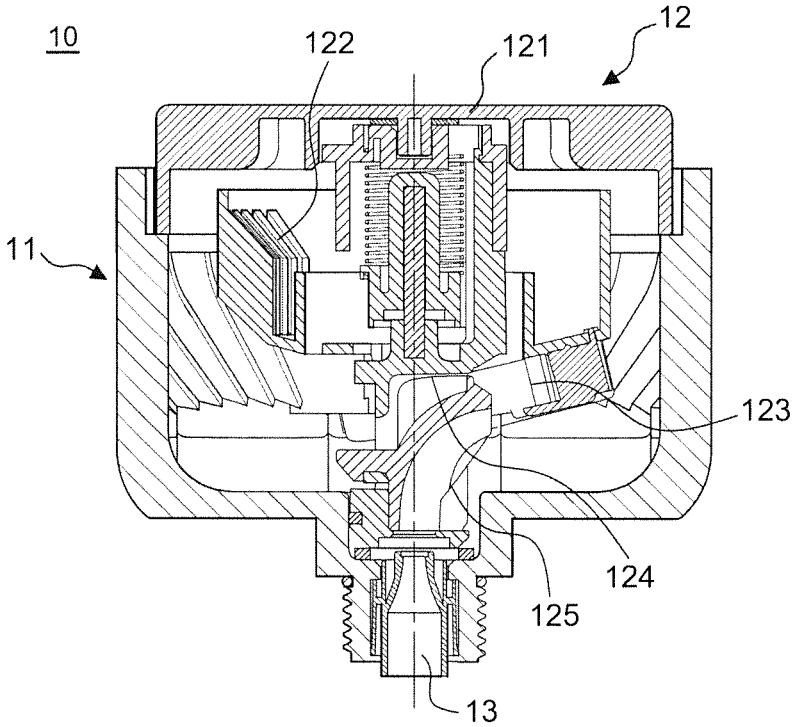
FIG.1C PRIOR ART
FIG. 1C is a sectional view of the conventional sprinkler.
Figure 2:
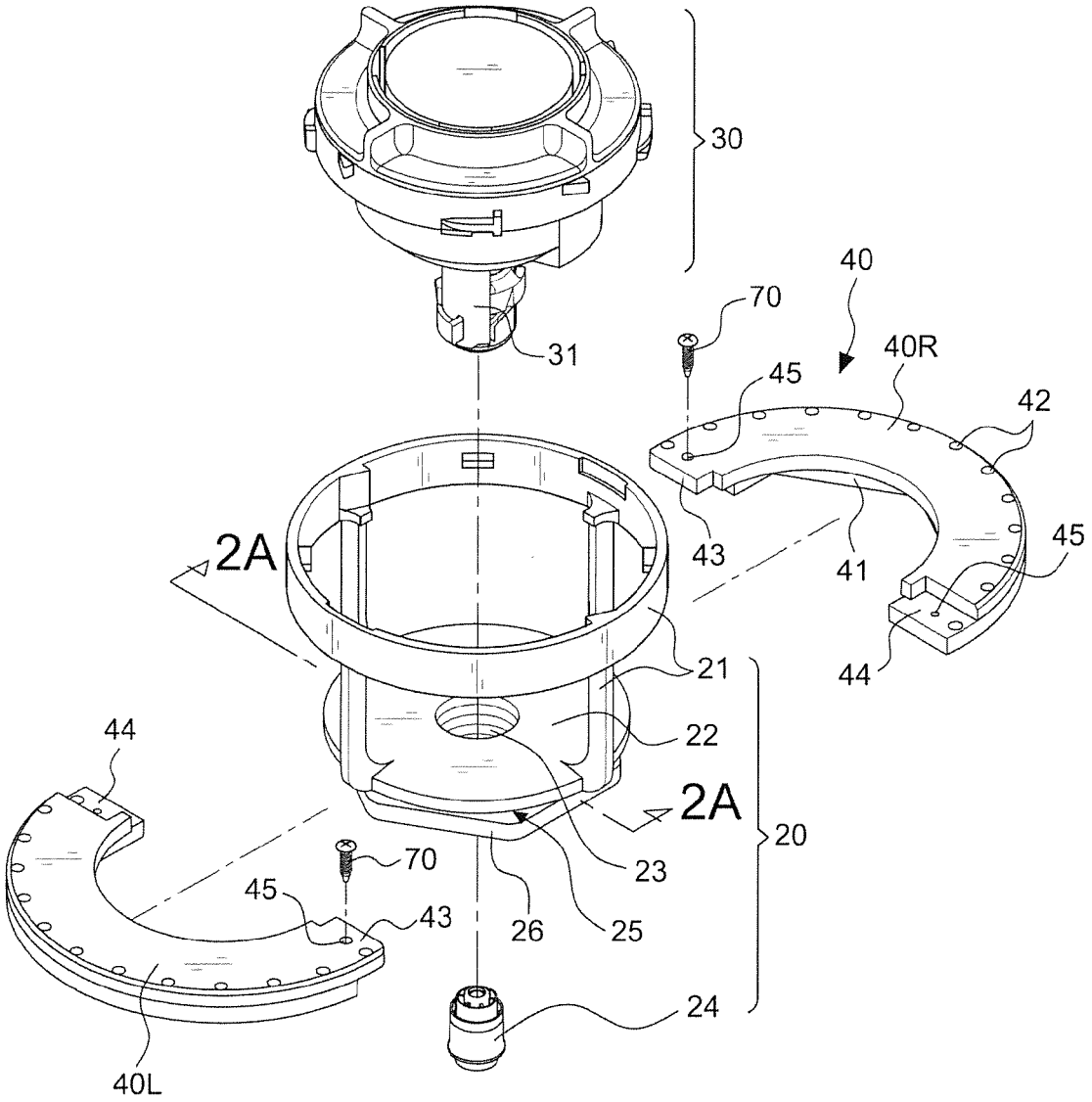
FIG. 2 is an exploded elevational view of the preferred embodiment in accordance with the present invention.
Figure 10:
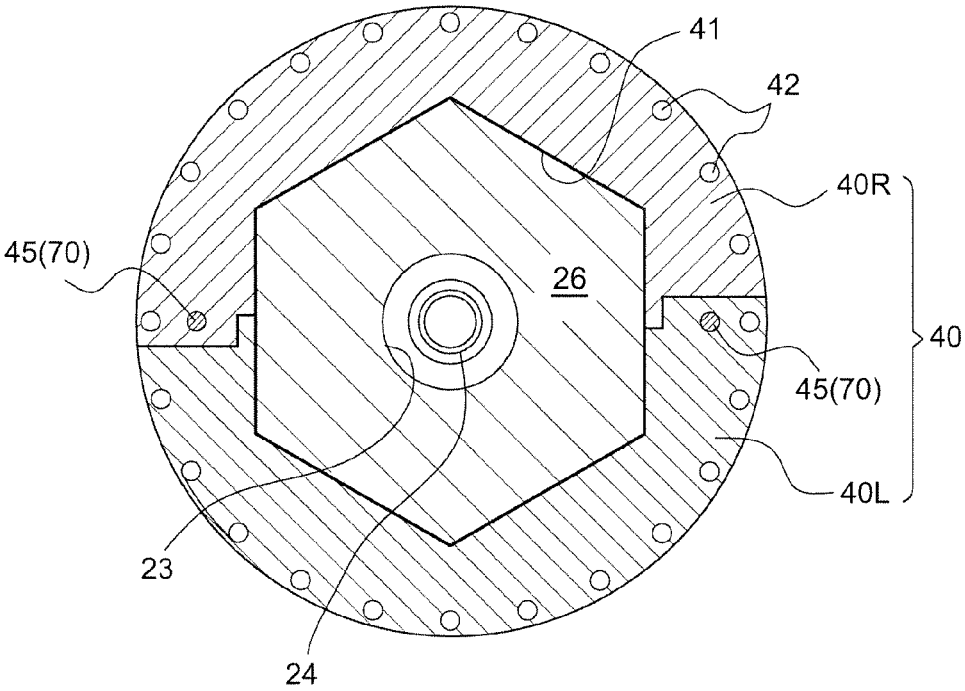
FIG. 10 is a cross-section view of the present invention taken along line 10-10 of FIG. 9.

Referring to FIGS. 2 and 10, the preferred embodiment of a shield assembly of low-flow sprinkler in accordance with the present invention comprises: a support body 20 composed of a rib 21 and a bottom plate 22 and the bottom plate 22 having a through hole 23 at a middle thereof for arranging a nozzle 24; a low-flow sprinkler assembly 30 arranged in the support body 20 and having a rotation shaft 31 in the through hole 23. However, the support body 20 and details of the internal components of the low-flow sprinkler assembly 30 are prior art and thus will not be described in details here.

Figure 2A:
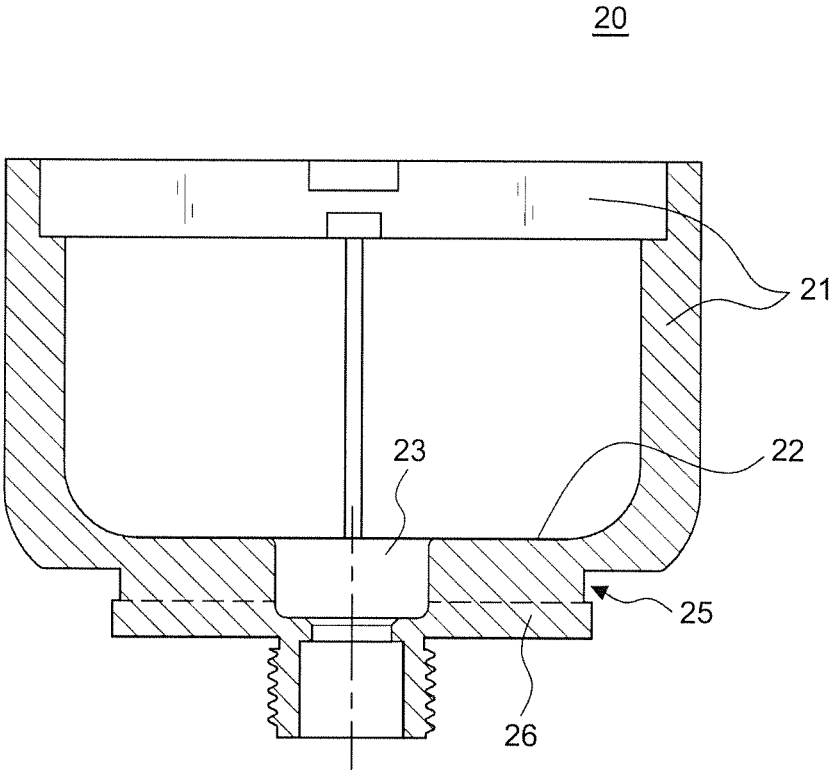
FIG. 2A is a cross-section view of the present invention taken along line 2A-2A of FIG. 2.
Figure 3:
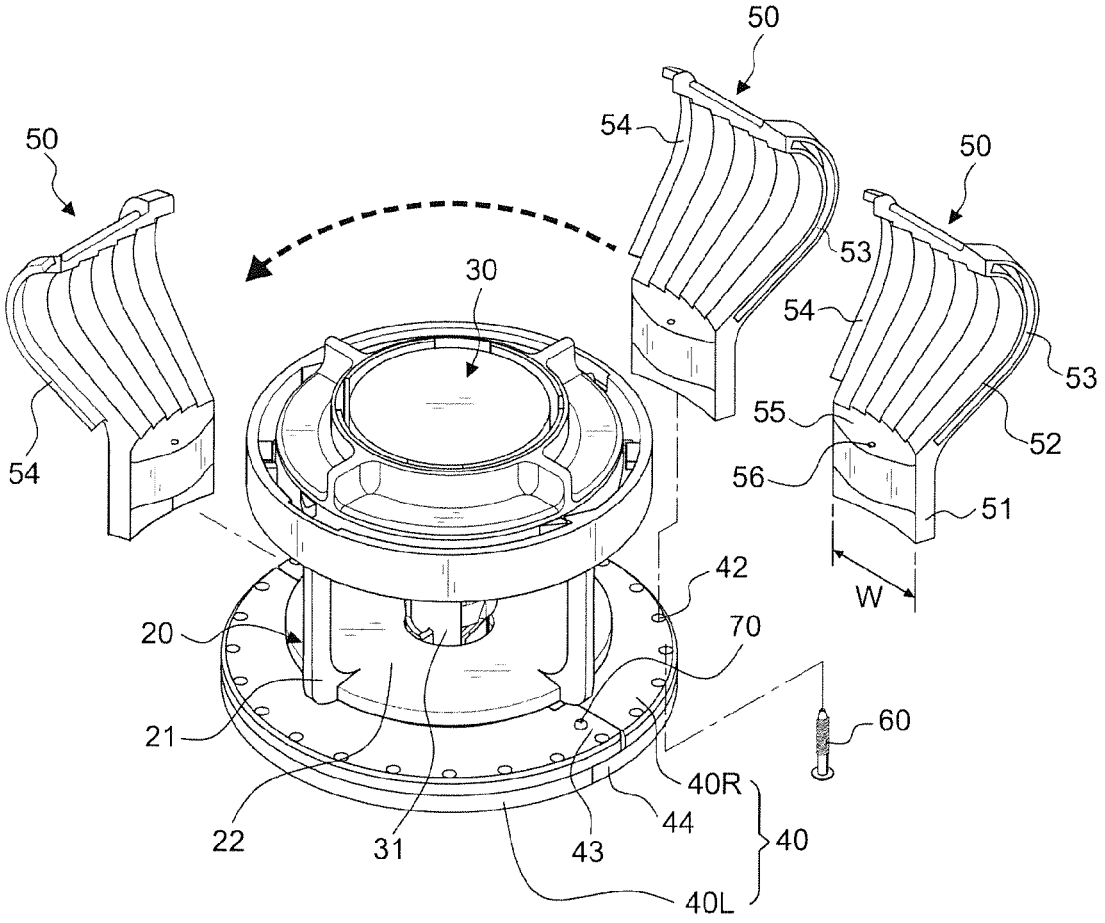
FIG. 3 is a partially exploded elevational view of the preferred embodiment in accordance with the present invention.
Figure 7:
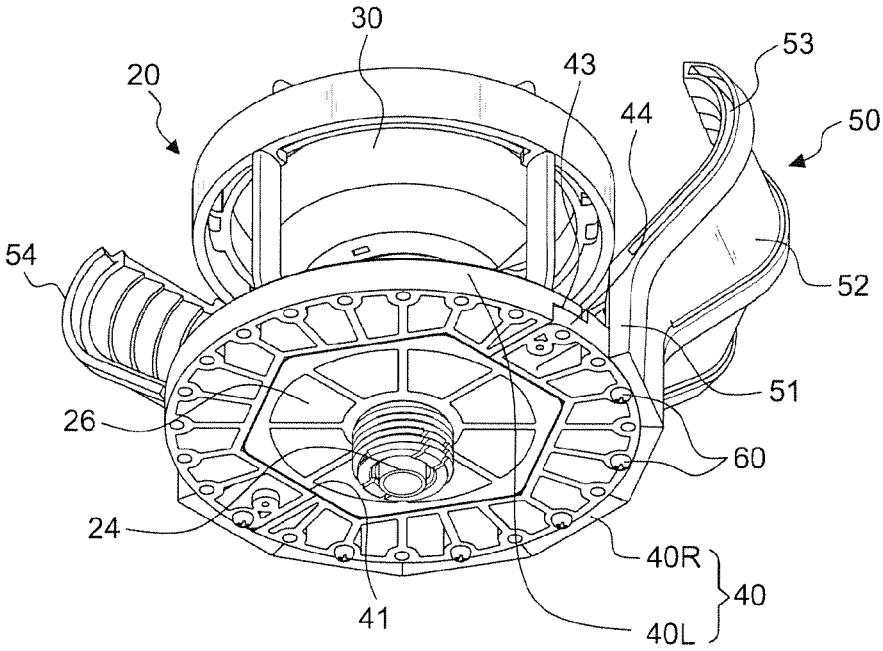
FIG. 7 is an elevational view of the preferred embodiment at another angle in accordance with the present invention.

With the reference to FIGS. 2 and 2A, the main features of the present invention include the bottom plate 22 having a bottom surface connected to a neck 25 and a bottom surface of the neck 25 having an equilateral polygon boss 26 as shown in FIG. 7 paralleling to the bottom plate 22; two pieces of semi-circular shield frame 40R, 40L corresponding to each other arranged at both sides of the neck 25 to form a circular convex ring body 40, a bottom surface of the circular convex ring body 40 corresponding to the equilateral polygon boss 26 having an equilateral polygon recessed frame 41 to fix on the equilateral polygon boss 26 and locate at a periphery of the bottom plate 22 and a plurality of equally spaced mounted holes 42 axially arranged at a periphery of the circular convex ring body 40. In this embodiment as shown in FIGS. 2 and 3, the two pieces of the semi-circular shield frame 40 have an end forming a convex surface 43 and another end forming a recessed surface 44 to overlay each other and both convex surface 43 and recessed surface 44 have a screw hole 45 to be fixed together by a short screw 70.

Figure 4:
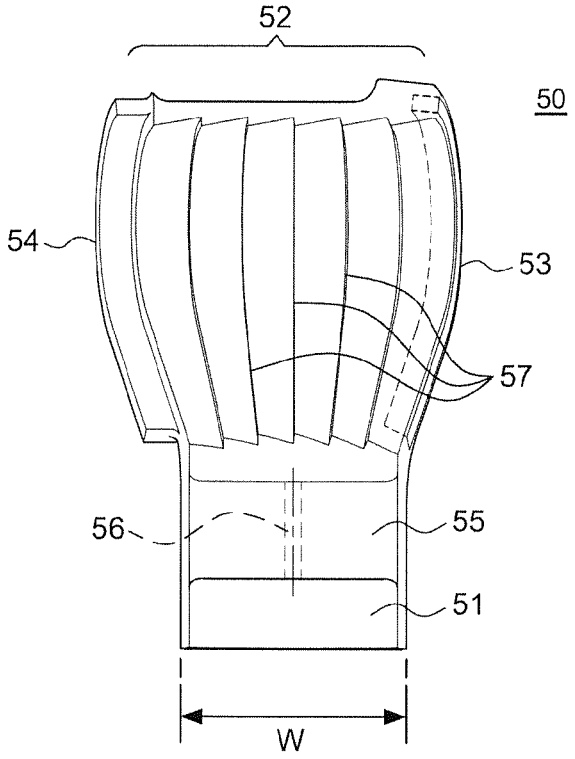
FIG. 4 is a front elevational view of the shield unit in accordance with the present invention.
Figure 5:
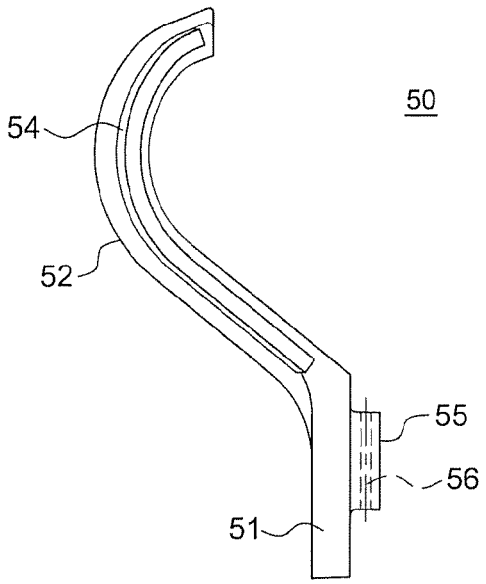
FIG. 5 is a side elevational view of the shield unit in accordance with the present invention.
Figure 6:
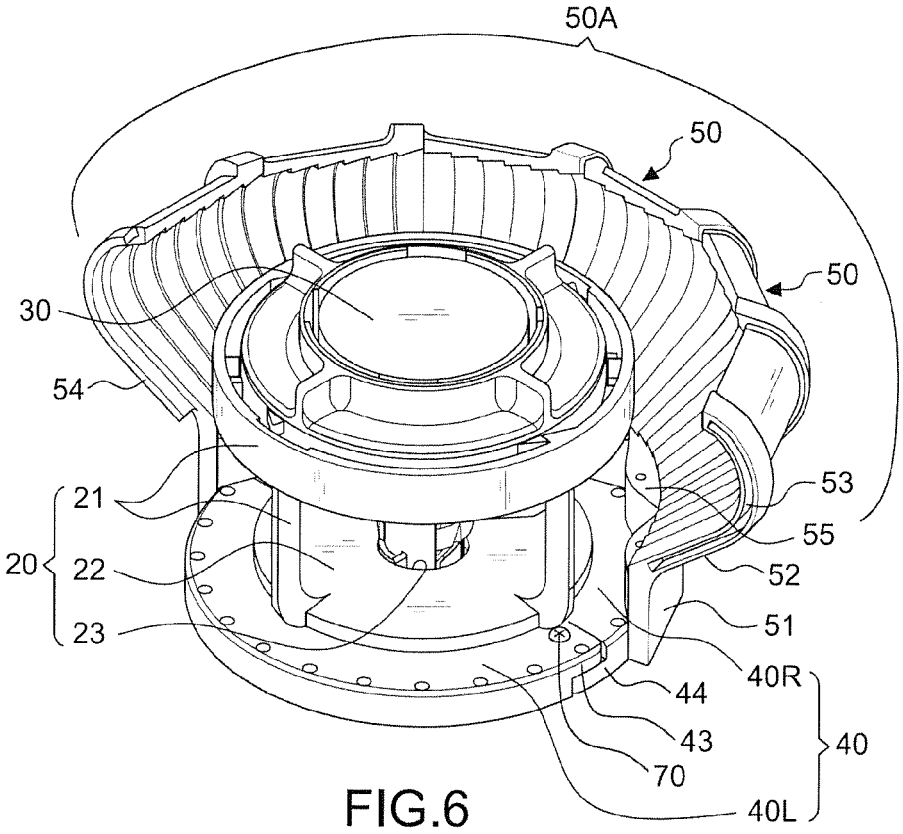
FIG. 6 is an elevational view of the preferred embodiment in accordance with the present invention.

A plurality of shield units 50 corresponding to an outer periphery of the circular convex ring body 40 has a curved plate body 51. The plate body 51 has a width W between ⅛ and 1/16 of the outer periphery of the circular convex ring body 40. In the embodiment, the width W of the plate body 51 is 1/12 but it is not a limitation; that is, each shield unit 50 has a circumference width of about 30°. Moreover, the curved plate body 51 is upward extended to form an inward curved body 52 and the curved body 52 has a curved concave groove 53 at a front side wall thereof A curved convex rib 54 is arranged at a rear side thereof for inserting into the curved concave groove 53 such that the predetermined numbers of the shield units 50 are sequentially combined. Each plate body 51 has a flange 55 at an inner edge surface thereof to set across the circular convex ring body 40 and the flange 55 has an axial screw hole 56. With the reference to FIG. 4, the curved body 52 of the shield unit 50 has a ratchet surface 57 at an inner edge surface thereof for guiding the water flow.

A plurality of long screws 60 is upward extending from a bottom surface of the mounted hole 42 of the circular convex ring body 40 to lock into the axial screw hole 56 of the flange 55.

Whereby a plurality of the shield units 50 are sequentially combined to form an arc-shaped shield 50A and the flange 55 is fixed on the circular convex ring body 40 to adjust the number of combinations of the shield unit 50 as required in order to control the sprinkling angle.

Figure 8:
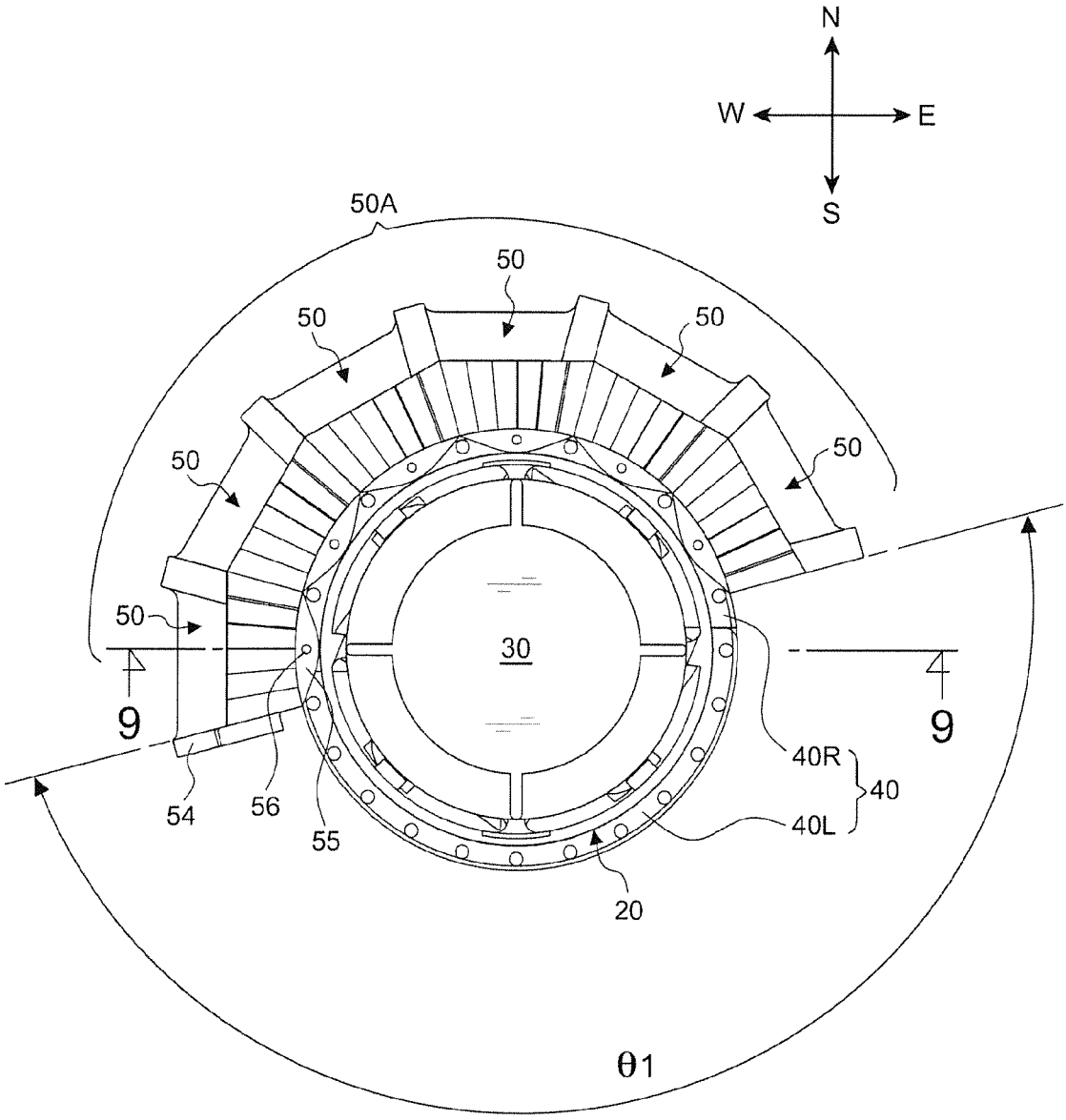
FIG. 8 is a top plan view of the preferred embodiment in accordance with the present invention.
Figure 9:
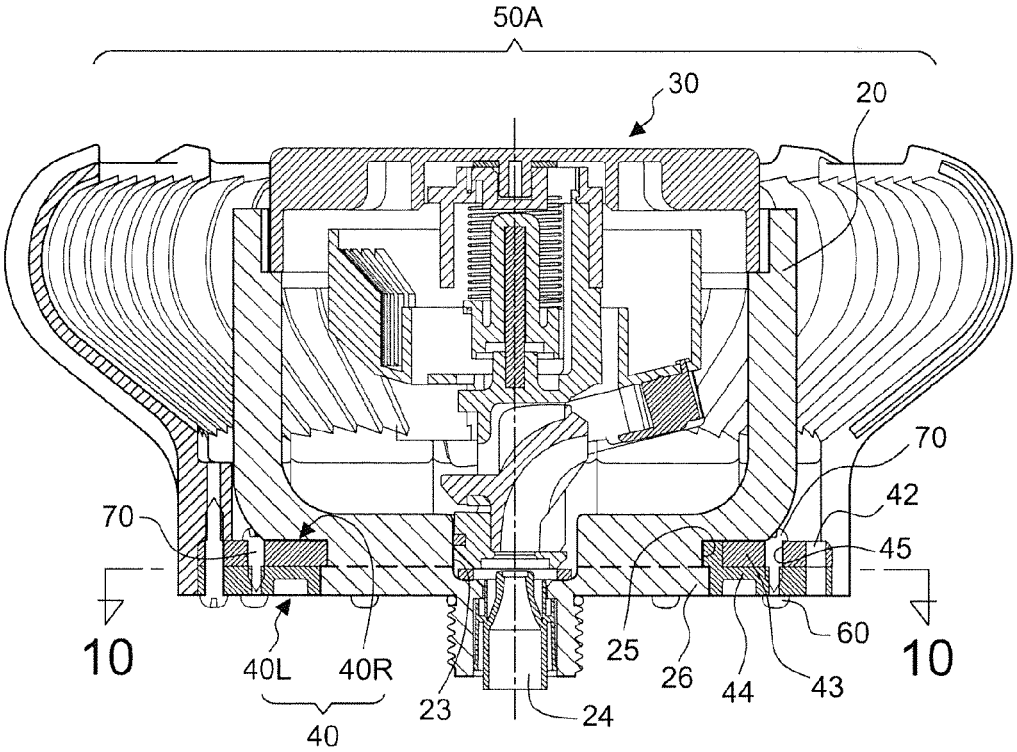
FIG. 9 is a cross-section view of the present invention taken along line 9-9 of FIG. 8.

With the reference to FIGS. 8 to 10, there are six shield units 50 sequentially combined to form the arc-shaped shield 50A generally facing toward the south and the sprinkling angle θ1 thereof is in the width of 0°~180°. That is, the present invention is able to control the sprinkler in a predetermined orientation and angle in order to save water.

Figure 11:
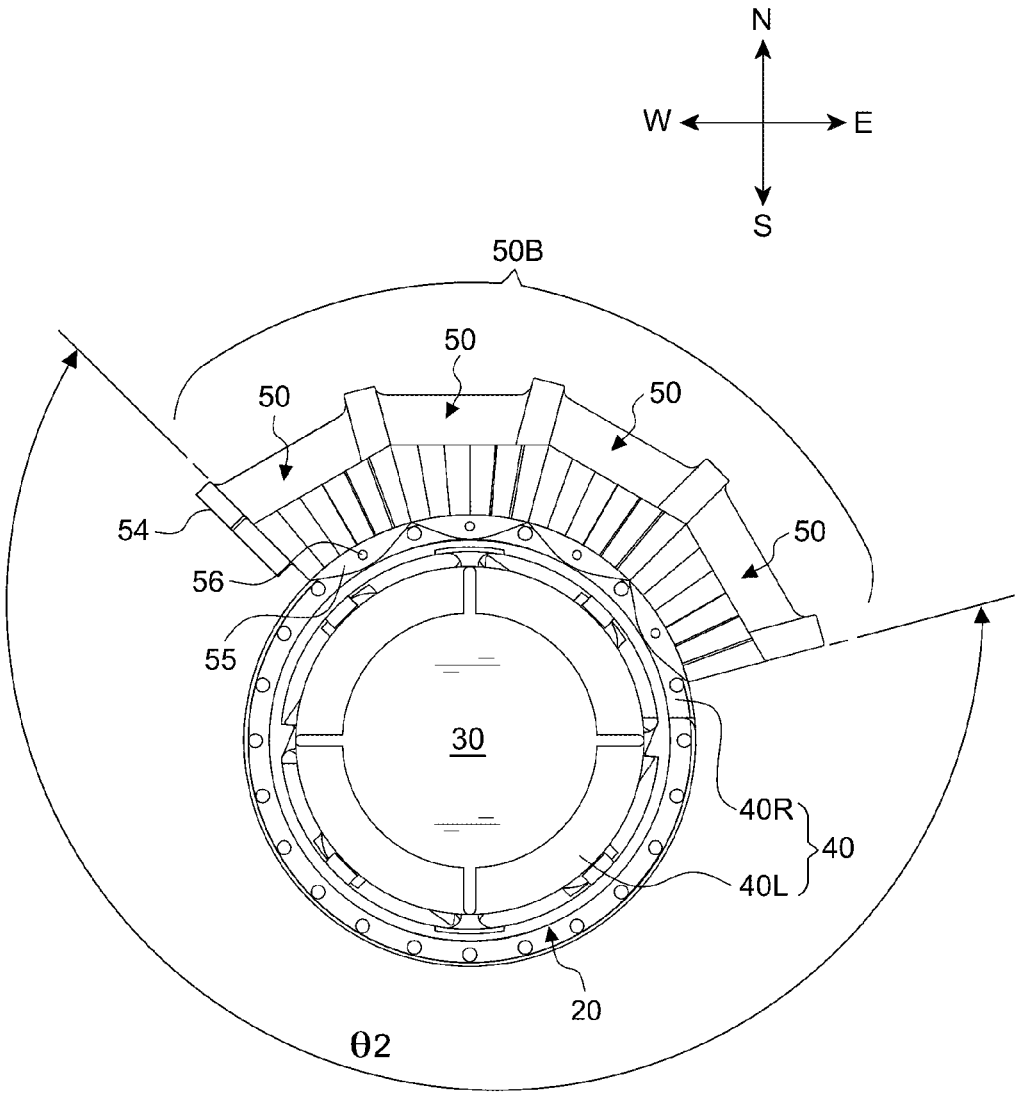
FIG. 11 is a top plan view of another preferred embodiment in accordance with the present invention.
Figure 12:
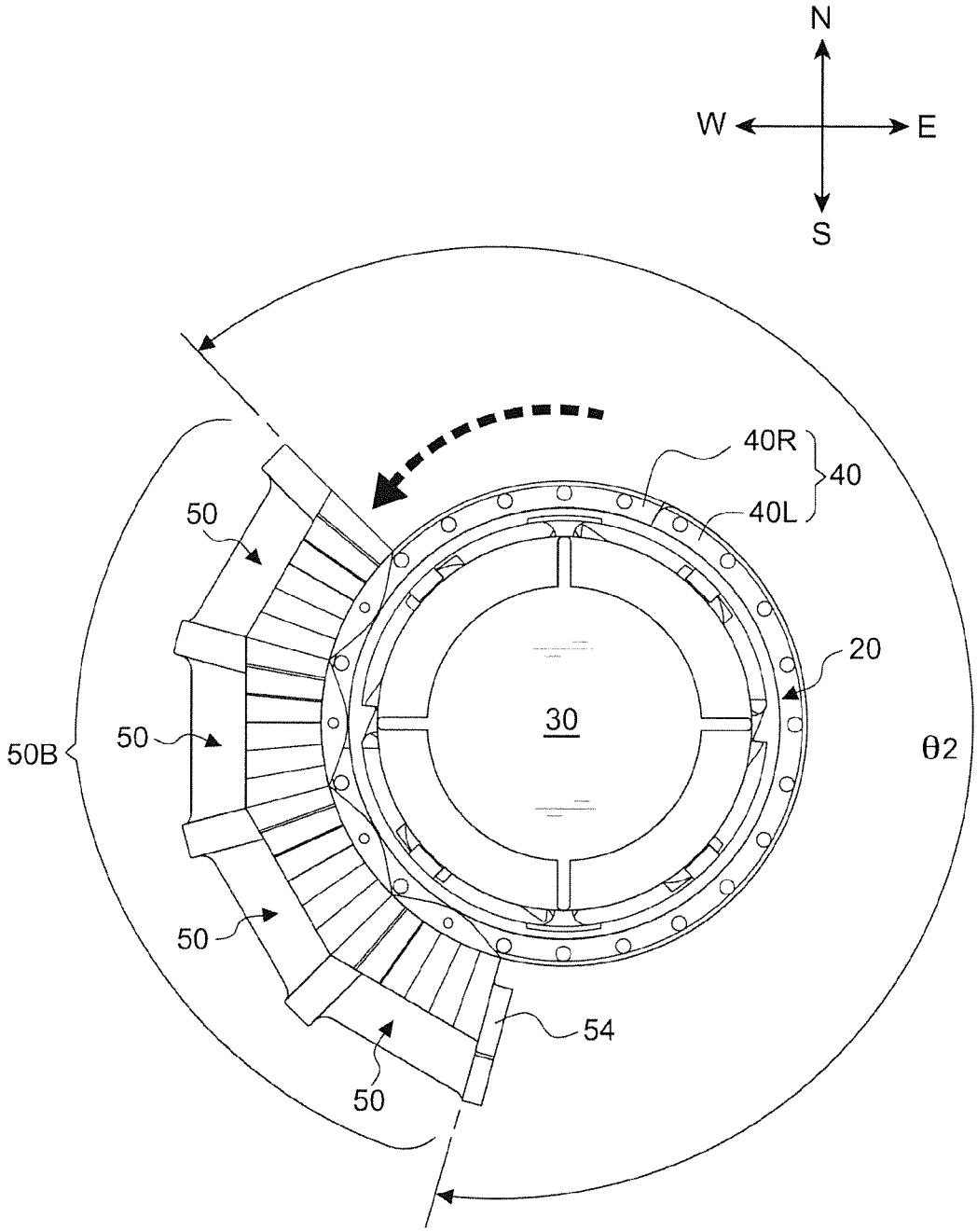
FIG. 12 is a schematic view of the orientation adjustment of the shield unit in FIG. 11.

FIG. 11 illustrates another embodiment in accordance with the present invention. There are four shield units 50 sequentially combined to form the arc-shaped shield 50B having the sprinkling angle θ2 in the width of 0°~240° to expand the sprinkling area. With the reference to FIG. 12, the arc-shaped shield 50A or arc-shaped shield 50B is disassembled into two semi-circular shield frame 40L, 40R as shown in FIG. 2 by the circular convex ring body 40 to adjust the fixed position of the equilateral polygon recessed frame 41 and equilateral polygon boss 26 as shown in FIG. 10 and then re-combine the shield units 50. Since the equilateral polygon boss 26 in the present embodiment is an equilateral hexagon so that the circular convex ring body 40 moved to a side may turn an angle of 60° and so forth. Therefore, the present invention can adjust the orientation of the sprinkler as required.

Moreover, the present invention is easily to be installed on the low-flow sprinkler and is convenience to adjust sprinkling orientation for the required sprinkling area and to increase or decrease the number of shield units 50 for adjusting the sprinkling angle in order to enhance sprinkling orientation and angle precision and achieve easy operation.

What is claimed is:

1. A shield assembly of low-flow sprinkler, comprising:

a support body composed of a rib and a bottom plate and the bottom plate having a through hole at middle thereof for arranging a nozzle;

a low-flow sprinkler assembly arranged in the support body and having a rotation shaft in the through hole;

wherein the bottom plate has a bottom surface connected to a neck and a bottom surface of the neck has an equilateral polygon boss paralleling to the bottom plate;

two pieces of semi-circular shield frame corresponding to each other are arranged at both sides of the neck to form a circular convex ring body, a bottom surface of the circular convex ring body corresponding to the equilateral polygon boss has an equilateral polygon recessed frame to fix on the equilateral polygon boss and locate at a periphery of the bottom plate and a plurality of equally spaced mounted holes are axially arranged at a periphery of the circular convex ring body;

a plurality of shield units corresponding to an outer periphery of the circular convex ring body has a curved plate body, the plate body has a width between ⅛ and 1/16 of the outer periphery of the circular convex ring body, the curved plate body is upward extended to form an inward curved body, the curved body has a curved concave groove at a front side wall thereof and a curved convex rib is arranged at a rear side thereof for inserting into the curved concave groove such that the predetermined number of the shield units are sequentially combined, each plate body has a flange at an inner edge surface thereof to set across the circular convex ring body and the flange has an axial screw hole; and a plurality of long screws are upward extending from a bottom surface of the mounted hole of the circular convex ring body to lock into the axial screw hole of the flange;

whereby a plurality of the shield units are sequentially combined to form an arc-shaped shield and the flange is fixed on the circular convex ring body to adjust the number of combinations of the shield unit as required in order to control the sprinkling angle and the circular convex ring body is disassembled into two semi-circular shield frame to adjust the orientation of the arc-shaped shield in order to re-combine the shield units.

2. The shield assembly of low-flow sprinkler as claimed in claim 1, wherein the two pieces of the semi-circular shield frame have an end forming a convex surface and another end forming a recessed surface to overlay each other and both convex surface and recessed surface have a screw hole to be fixed together by a short screw.

3. The shield assembly of low-flow sprinkler as claimed in claim 1, wherein the curved body of the shield unit has a ratchet surface at an inner edge surface thereof.

* * * * *